United States Patent [19]

Schow

[11] 3,994,500

[45] Nov. 30, 1976

[54] MUSICAL COMPOSITION BOARD GAME

[76] Inventor: Sylvia Jessop Schow, 2774 Delaware Ave., Redwood City, Calif. 94061

[22] Filed: June 24, 1974

[21] Appl. No.: 481,987

[52] U.S. Cl. ..... 273/134 AD; 273/134 C; 273/134 D; 273/134 E; 273/137 R; 84/470

[51] Int. Cl.[2] ..... A63F 3/00

[58] Field of Search ..... 273/134, 135

[56] References Cited

UNITED STATES PATENTS

| | | | |
|---|---|---|---|
| 3,729,198 | 4/1973 | Shaffer | 273/134 AC |

FOREIGN PATENTS OR APPLICATIONS

| | | | |
|---|---|---|---|
| 451,954 | 10/1948 | Canada | 273/135 B |
| 840,861 | 1/1939 | France | 273/135 B |

*Primary Examiner*—Delbert B. Lowe
*Attorney, Agent, or Firm*—Roland I. Griffin

[57] ABSTRACT

Two or more players move respective playing pieces in turn around a peripheral portion of a playing board as determined by spinning a spin dial. The peripheral portion of the playing board is divided into colored spaces including different musical symbols or terms used in musical composition. Each player uses the musical symbols or terms included in the spaces on which his or her playing piece lands to compose four measures of music in the major key of C. Play money is given to each player based on the popularity of his or her musical composition as determined by throwing numeric dice and for other reasons based on chance and skill. The winner is the player who earns the most play money while completing four measures of music. Different awards are given to the players based on the amount of play money they earn. More advanced players may increase the number of measures of music to be composed, may compose their music in a key other than C, as determined by throwing alphabetic dice, and may employ accompaniments selected by themselves or determined by drawing cards bearing different accompaniments.

30 Claims, 29 Drawing Figures

EXPLANATORY CARD (FOR ORANGE SPACES ON THE PLAYING BOARD)

You must use the designated time signature ( $\frac{2}{4}$, $\frac{5}{8}$, $\frac{6}{8}$, $\frac{3}{4}$, or $\frac{4}{4}$ ). If you use either the $\frac{5}{8}$ time signature or the $\frac{6}{8}$ time signature collect $75 in play money. Also collect $75 in play money for each additional time signature you use.

You may use either the illustrated measure of notes or up to as many notes of your own selection as equal one measure of notes in the designated time signature. Different kinds of notes that can be used, their notation, and some of their equivalents are given below.

| KINDS | NOTATION | EQUIVALENTS |
|---|---|---|
| whole | 𝅝 | 𝅗𝅥 𝅗𝅥, 𝅗𝅥. ♩ |
| dotted half | 𝅗𝅥. | 𝅗𝅥 ♩, ♩ ♩ ♩ |
| half | 𝅗𝅥 | ♩ ♩, ♩. ♪ |
| dotted quarter | ♩. | ♩ ♪, ♫ ♪ |
| quarter | ♩ | ♫, ♫. |
| dotted eighth | ♪. | ♪ ♪, ♬ ♪ |
| eighth | ♪ | ♬ |
| sixteenth | 𝅘𝅥𝅯 | |

12

Figure 2

EXPLANATORY CARD (FOR GREEN SPACES ON THE PLAYING BOARD)

If you use the designated musical term collect $125 in play money. The number of notes used in accordance with the designated musical term may not exceed one measure of notes in your designated time signature. Definitions of the musical terms designated in the green spaces and examples of how they are used are given below.

ANACRUSIS: An upbeat. A note or two preceding the first full measure as illustrated by the following examples --

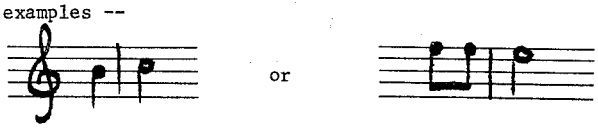

DIMINUTION: The same melody is repeated not necessarily with the same tones, but with faster note values (usually twice as fast) as illustrated by the following examples --

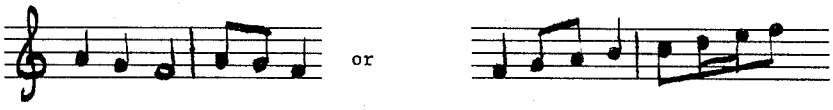

NEIGHBORING TONE: A tone that steps away and then returns to the same tone from which it came as illustrated by the following examples --

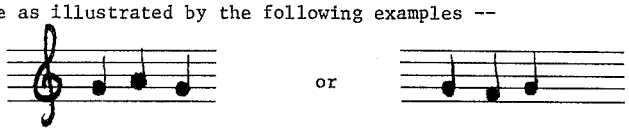

SEQUENCE: The repetition of a melodic pattern an interval higher or lower as illustrated by the following examples --

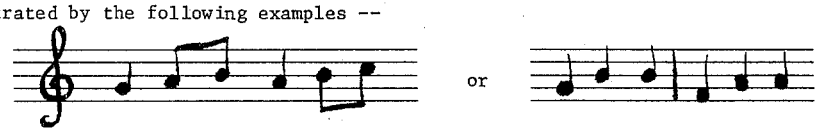

SYNCOPATION: A rhythm in which the accent is on a normally unaccented beat as illustrated by the following examples --

2, 3, 4 / 4, 4, 4 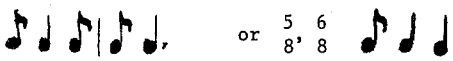 or 5, 6 / 8, 8

TRIPLET: A rhythm in which three notes have the same value as two notes as illustrated by the following examples --

2, 3, 4 / 4, 4, 4 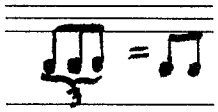 or 5, 6 / 8, 8 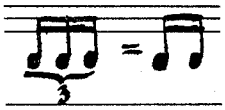

12

ADVANCED GAME VARIATION: If you land on SYNCOPATION and notate an accompaniment you may use a swing bass in your accompaniment and collect $125 in play money.

Figure 3

EXPLANATORY CARD (FOR BLUE SPACES ON THE PLAYING BOARD)

You may use any one or more of the designated musical symbols or other musical symbols as indicated below (not exceeding one measure of those musical symbols in your designated time signature). Definitions of the musical symbols designated in the blue spaces are given below.

ACCIDENTALS: Symbols indicating pitch is to be raised or lowered a half step as indicated by the following --

♯ (sharp) = a half step higher

♭ (flat) = a half step lower

♮ (natural) = a flat or sharp to be cancelled

DOTTED RHYTHMS: An arrangement of notes in which at least one note has a dot placed alongside it to indicate one and one half times the value of that note, as illustrated by the following examples -- ♩. ♪ or ♩. ♪ ♪

RESTS: Symbols indicating silence. They may be substituted for notes and their duration equals the notes for which they are being substituted as indicated by the following --

𝅝 (whole note) = 𝄻 (whole rest)

𝅗𝅥 (half note) = 𝄼 (half rest)

♩ (quarter note) = 𝄽 (quarter rest)

♪ (eighth note) = 𝄾 (eighth rest)

𝅘𝅥𝅯 (sixteenth note) = 𝄿 (sixteenth rest)

⁀ : Symbol used either as a slur connecting two or more notes of different pitch to be played smoothly or as a tie connecting two or more notes of the same pitch to provide a sustained pitch having a duration equal to the duration of all the connected notes. A tie is illustrated by the following example --

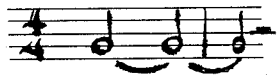

= 6 beats

𝄇 : Repeat one or more notes with or without dynamic change as indicated by the following examples (if you land on this purple space you may use the dynamic changes forte and piano without landing on the purple spaces designated by the abbreviations *f* and *p* of those dynamic changes) --

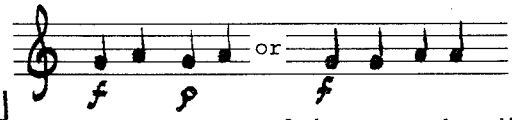

𝅝, 𝅗𝅥., 𝅗𝅥 : Use any one or more of these notes depending on your time signature and/or need.

8va: Notate either an octave higher or an octave lower.

< > : Use a crescendo (<) indicating gradually increasing volumne, a dimuendo (>) indicating gradually decreasing volume, or both.

ADVANCED GAME VARIATIONS: If you land on ACCIDENTALS and notate an accompaniment you may use dissonance in your accompaniment and collect $150 in play money or you may use modulation in your accompaniment and collect $200 in play money. If you land on DOTTED RHYTHMS and notate an accompaniment you may use a boogie bass in your accompaniment and collect $125 in play money.

12

Figure 4

EXPLANATORY CARD (FOR PURPLE SPACES ON THE PLAYING BOARD)

If you use the designated musical term collect $100 in play money. Do not throw the popularity dice. Definitions of the musical terms designated in the purple spaces are given below.

ALLEGRO: Quick

ANDANTE: Slow (walking speed)

*f* (abbreviation for forte): Loud

*p* (abbreviation for piano): Soft rit. (abbreviation for ritardendo): Gradually slower Both allegro and andante are notated above the staff at the desired starting place (for example, above the clef mark). Forte ( *f* ), piano ( *p* ), and ritardendo (rit.) are all notated below the staff at the desired starting place (for example, below the clef mark).

12

Figure 5

EXPLANATORY CARD (FOR WHITE SPACES ON THE PLAYING BOARD)

You may use any one or more of the designated musical symbols (not exceeding one measure of those musical symbols in your designated time signature). Definitions of the musical symbols designated in the white spaces are given below.

SKIP(S): You may notate successive notes on noncontiguous lines and spaces of a staff so that each note is separated from its neighboring note or notes by at least one line or space as indicated by the following --

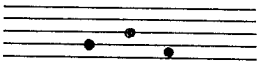

STEP(S): You may notate successive notes on contiguous lines and spaces of a staff so that each note is positioned on a line or space adjoining each line or space on which its neighboring note or notes are positioned as indicated by the following --

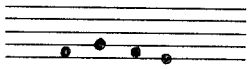

tr.w : Symbol indicating trill, a musical ornament played by quickly alternating the written note with a note a major second interval (M2) or a minor second interval (m2) above it.

(accent): Emphasis

: Symbol indicating grace note, a fast melodic ornament without rhythm that usually precedes a principal note and that is usually notated smaller in size.

: Symbol indicating turn, a melodic ornament using the principal note in combination with both the upper and lower neighboring notes as indicated by the following --

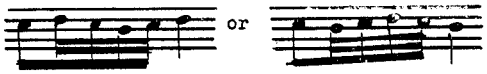

(fermata): Hold (staccato): Short

ADVANCED GAME VARIATION: If you land on SKIP(S) and notate an accompaniment you may add to any existing chord in your accompaniment another one or two thirds making a 7th or 9th chord (some of the middle notes may be omitted from the 7th or 9th chord) and collect $150 in play money.

12

Figure 6

MUSICAL COMPOSITION BOARD GAME

BACKGROUND AND SUMMARY OF THE INVENTION

This invention relates to a board game in which the players compose music and earn play money as they do based on chance and skill.

A principal object of this invention is to provide a musical composition game that is both educational and fun and that helps the players develop creativity and appreciation for music.

Another object of this invention is to provide a musical composition game that involves both chance and skill and that may be played by both young people and adults and by people of widely varying musical ability.

These objects are accomplished according to the preferred embodiment of this invention by providing a musical composition game employing a playing board with a peripheral portion divided into thirty-two spaces each colored one of five different colors and each including a different musical symbol or term used in musical composition. The game is played by two or more players each of whom is provided with a different playing piece, preferably in the form of a famous musical composer, and each of whom in turn moves his or her playing piece around the peripheral portion of the playing board as determined by spinning a spin dial. Each player uses the musical symbols or terms included in the spaces on which his or her playing pieces lands to compose four measures of music on a sheet of music paper in the major key of C. Play money is given to each player following completion of his or her first measure of music and also following completion of each of his or her turns thereafter, except when his or her playing piece lands on a space colored a particular one of the five different colors. The amount of play money given is based on the popularity of his or her musical composition at that point in the game as determined by the throw of three numeric dice. Play money is also given to each player for other reasons based on chance and skill and as a bonus to the first player who completes four measures of music. The winner is the player who earns the most play money while completing four measures of music. Different awards are given to the players based on the total amount of play money they earn.

More advanced players may play an advanced form of the game in which either four or eight measures of music are composed. These measures may be composed in a major key other than C as determined by throwing an alphabetic die denoting different major keys other than C or, alternatively, in a minor key as determined by throwing an alphabetic die denoting different minor keys. In the advanced form of the game, each musical composition may also include an accompaniment selected by the player or determined by drawing one of a group of cards bearing different accompaniments. Some of the space in the peripheral portion of the playing board include colored stars denoting more advanced techniques of musical composition that may be employed by each advanced player when his or her playing piece lands on those spaces. Additional play money is given to each advanced player for composing measures of music in a minor key or a major key other than C, for employing an accompaniment, and for employing each of the more advanced techniques of musical composition. Each advanced player otherwise earns play money based on chance and skill as in the regular form of the game. Advanced and beginning players may enjoyably play the advanced and regular forms of the game at the same time since chance is also involved in the advanced form of the game and greater skill is required of advanced players.

DESCRIPTION OF THE DRAWINGS

The preferred form of the equipment used in playing both the regular and advanced forms of a musical composition game according to the preferred embodiment of this invention is illustrated in FIGS. 1–29 briefly summarized below.

FIGS. 2–6 are plan views of five cards bearing explanations of musical symbols and terms included on the playing board of FIG. 1.

DESCRIPTION OF THE PREFERRED EMBODIMENT

Figure 1:
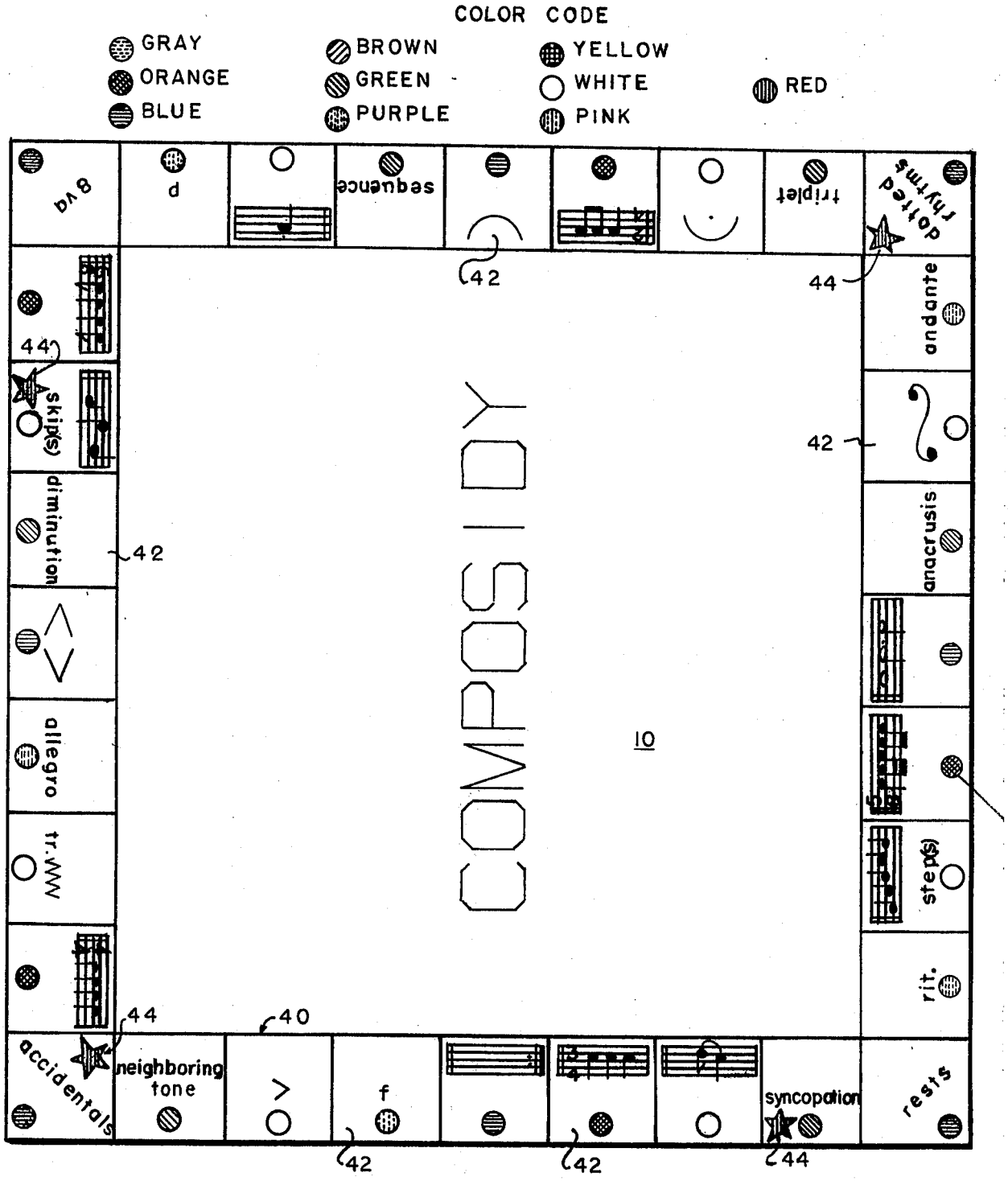
FIG. 1 is a plan view of the playing board for the game.

A detailed description of both regular and advanced forms of a musical composition game according to the preferred embodiment of this invention is given below with the aid of FIGS. 1–29. This description explains who may play the game, describes the equipment used in playing both the regular and advanced forms of the game, sets forth the object of the game, and explains how to play both the regular and advanced forms of the game. A glossary of musical terms used in connection with both the regular and advanced forms of the game follows this description.

PLAYERS

The game is played by two or more players. They may range in age from about ten years and up. Virtually anyone who has any understanding of music or who has the ability and desire to learn something about music can play or learn to play the game. People of greatly different skill may enjoyably play one another since both the advanced and regular forms of the game may be played at the same time, since both the advanced and regular forms of the game involve chance as well as skill, and since greater skill is required of those playing the advanced form of the game.

EQUIPMENT

As shown in FIGS. 1–21, the game includes a playing board 10, a set of explanatory cards 12 for the playing board, a set of playing pieces 14, three identical numeric dice 16, a supply of music paper 18, a supply of play money 20, a spin dial 22, and a set of awards 24–32. All of this equipment is used in playing both the regular and advanced forms of the game. As shown in FIGS. 22–29, the game also includes two alphabetic dice 34 and 36 and a set of accompaniment cards 38. This equipment may be used in playing the advanced form of the game.

As shown in FIG. 1, the playing board 10 is provided with a peripheral portion 40 that extends around all sides of the playing board and that is divided into thirty-two different spaces 42. Each of these spaces 42 includes a different musical symbol or term used in musical composition and is colored either orange, green, blue, purple, or white as indicated by the circular color coding designation contained within each space (these and all other color coding designations should be viewed with reference to the normal position of the figure in which they appear) and the color coding key which is positioned above the playing board 10 and which is also used in connection with FIGS. 16 and 26–29.There are five orange spaces, six green spaces, eight blue spaces, five purple spaces, and eight white spaces. Each of the orange spaces 42 includes a different time signature, such as $_4^2$, $_4^3$, $_4^4$, $_8^5$, and $_8^6$, and a different measure of notes that may be used in that time signature. The green, blue, purple, and white spaces 42 include other musical symbols and terms relating to melody, rhythm, pitch, dynamics, and interpretation. Explanations of the musical symbols or terms included in every space 42 of the same color and directions related to those spaces and musical symbols or terms are given on a correspondingly colored one of the explanatory cards 12 as shown in FIGS. 2–6. For example, explanations of the musical symbols or terms included in every orange space 42 are given on the orange explanatory card 12 shown in FIG. 2, and explanations of the musical symbols or terms included in every green space 42 are given on the green explanatory card 12 shown in FIG. 3. Some of the green, blue, and white spaces 42 also include red colored stars 44 denoting variations explained below in the description of the advanced form of the game. Musical terms used in connection with these variations and other musical terms used in explaining and playing both the regular and advanced forms of the game and not included on the explanatory cards 12 are explained below in the glossary. Although the preferred form and arrangement of the game board 10 has been shown and described, other forms and arrangements including, for example, fewer or additional musical symbols and terms may also be employed.

Figure 7:
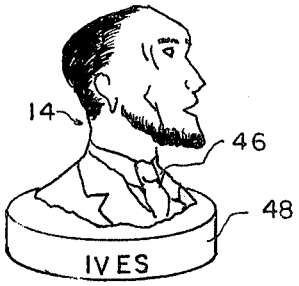
FIGS. 7 and 8 are perspective views of two of the playing pieces for the playing board of FIG. 1.
Figure 8:
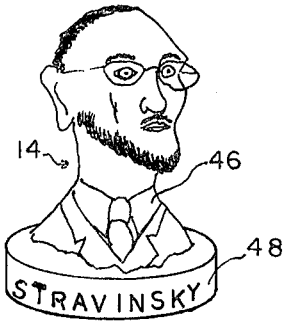

As shown in FIGS. 7 and 8, the playing pieces 14 preferrably comprise statuettes 46 of famous musical composers mounted on circular bases 48 bearing the names of those composers. Although only two such playing pieces 14 are shown in FIGS. 7 and 8, preferably six or more such playing pieces are provided. These playing pieces represent different composers such as Charles Ives (FIG. 7), Igor Stravinsky (FIG. 8), Burt Bacharach, Rodgers and Hammerstein, Ludwig Beethoven, George Gershwin, Claude Debussy, Henry Mancini, Stephen Foster, Arnold Schoenberg, Leonard Bernstein, Aaron Copland, Bela Bartok, and Paul Hindemith.

Figure 9:
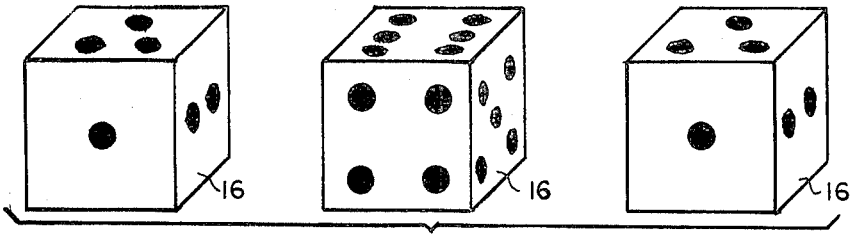
FIG. 9 is a perspective view of three identical numeric dice employed to determine the popularity of a musical composition formed during movement of a playing piece around the playing board of FIG. 1.

As shown in FIG. 9, each of the three identical numeric dice 16 has six sides with each side bearing the designation of a different number from 1 through 6. These three numeric dice are hereinafter collectively referred to as the popularity dice.

Figure 10:
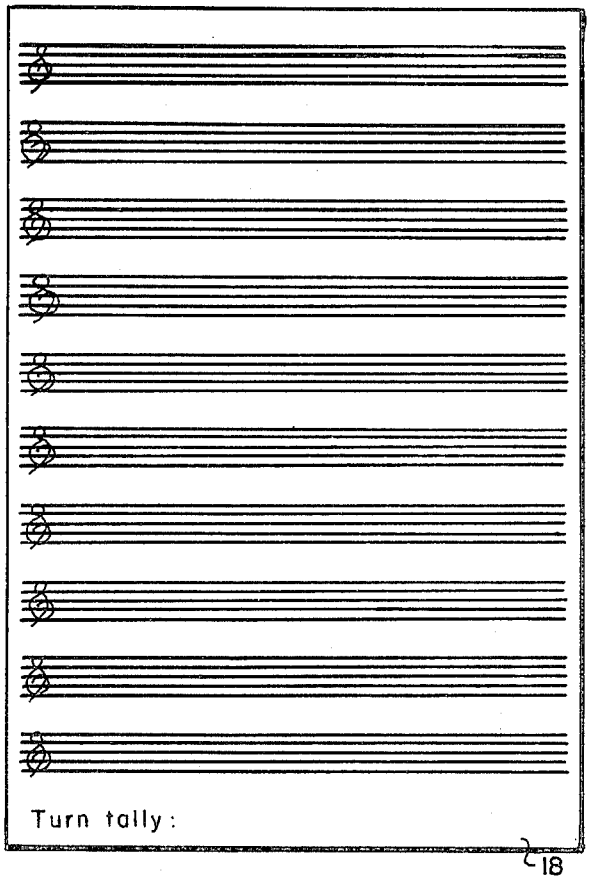
FIGS. 10 and 11 are plan views of two types of staff-lined music paper used by the players in notating their musical compositions.
Figure 11:
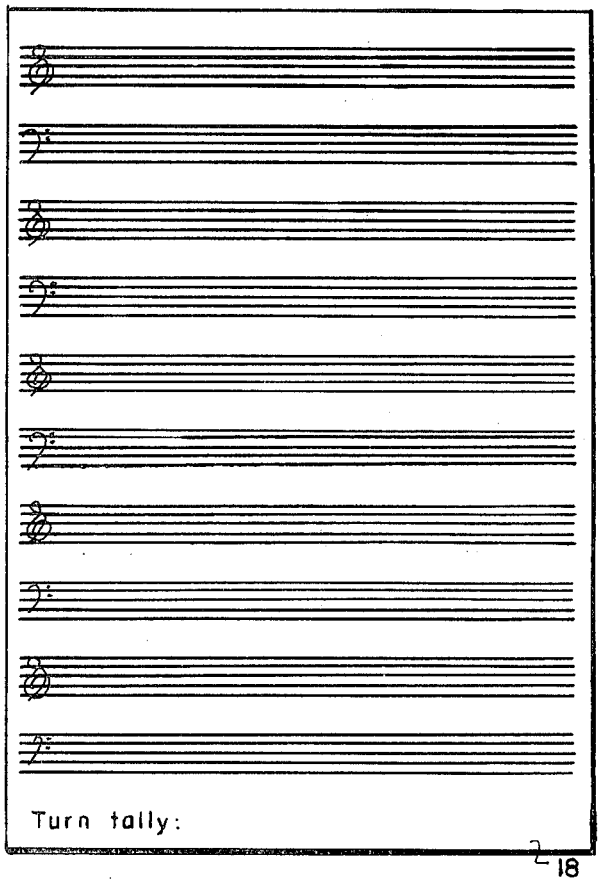
Figure 12:
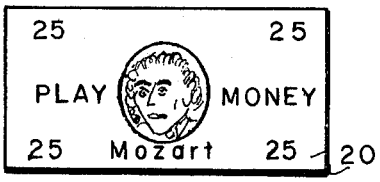
FIGS. 12–15 are plan views of different denominations of play money distributed to the players based on both chance and skill during the creation of their musical compositions.
Figure 13:
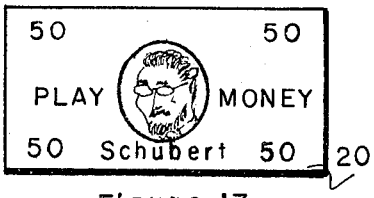
Figure 14:
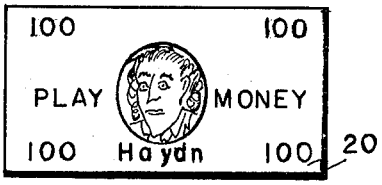

As shown in FIGS. 10 and 11, two types of staff-lined music player 18 are provided for the players' use in notating their musical compositions. One type is notated for treble clef (FIG. 10), and the other type is notated for both bass and treble clefs (FIG. 11). Still other types of music paper 18 can be employed and provided if desired. A supply of pencils may also be provided for the players' use in notating their musical compositions on the music paper 18.

Figure 15:
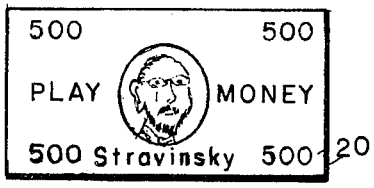

As shown in FIGS. 12–15, the play money 20 is provided in denominations of $25, $50, $100, and $500. Each denomination of play money preferably bears the name and likeness of a different famous musical composer such as Mozart (FIG. 12), Schubert (FIG. 13), Hayden (FIG. 14), and Stravinsky (FIG. 15). Other denominations of play money, such as $1,000, may also be provided. Each denomination of play money may be colored either the same color or different colors to further aid in recognizing the different denominations.

Figure 16:
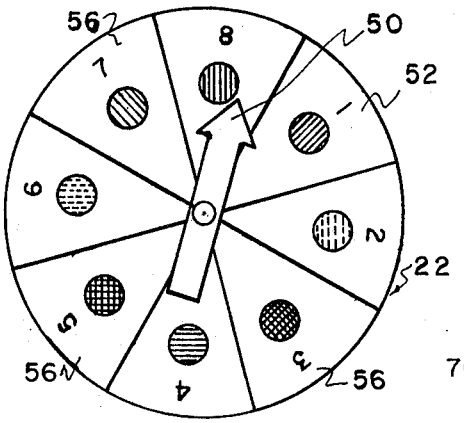
FIG. 16 is a plan view of a spin dial employed to regulate the movement of the playing pieces around the playing board of FIG. 1.
Figure 17:
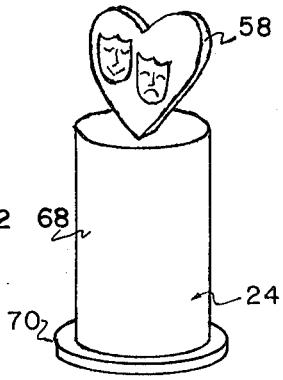
FIGS. 17–21 are perspective views of different awards that may be won by the players based on the amount of play money they earn during the creation of their musical compositions.
Figure 18:
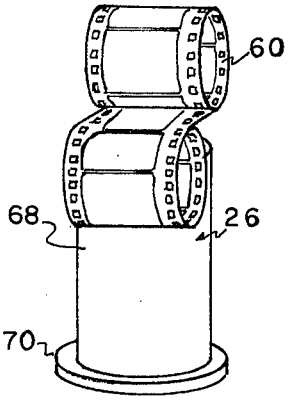
Figure 19:
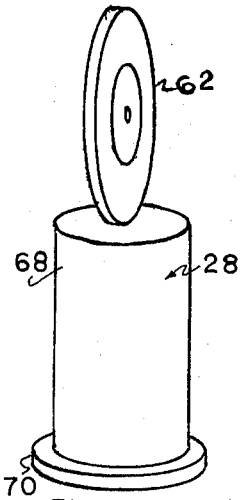
Figure 20:
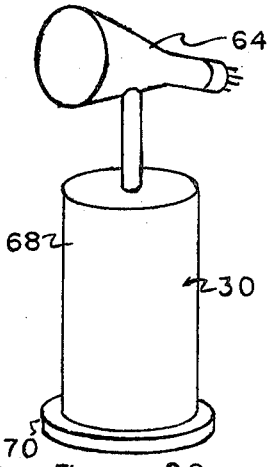

As shown in FIG. 16, the spin dial 22 includes a pointer 50 rotatably mounted on a circular base 52 by a rivet. The base 52 is divided into eight equal sectors 56 each bearing a different number from 1 through 8 and each colored either brown, purple, orange, blue, yellow, gray, green, or red as indicated by the circular color coding designation contained within each sector and the color coding key positioned above the playing board 10 in FIG. 1.

As shown in FIGS. 17–21, the award 24 comprises a FIG. 58 of a heart bearing a likeness of the theatrical masks for comedy and tragedy, the award 26 comprises a FIG. 60 of a roll of film, the award 28 comprises a FIG. 62 of a record, the award 30 comprises a FIG. 64 of a television tube, and the award 32 comprises a FIG. 66 of a downwardly pointing arrow bearing a reject label. Each of these awards 24–32 further comprises a cylindrical pedestal 68 on which the corresponding FIG. 58, 60, 62, 64, or 66 is mounted and a circular base 70 on which the corresponding pedestal 68 is mounted. In decreasing order of importance the awards 24–32 are hereinafter referred to as the Broadway Hit Parade Award 24, the Silver Screen Award 26, the Disk Award 28, the Telly Award 30, and the Rejection Slip Award 32. Preferably, several Rejection Slip Awards 32 and one of each of the other awards 24–30 are provided. Although the preferred forms and titles of the awards have been shown and described, other forms and titles may also be employed. For example, the Rejection Slip Award 32 may simply comprise a paper certificate entitled Rejection Slip.

Figure 22:
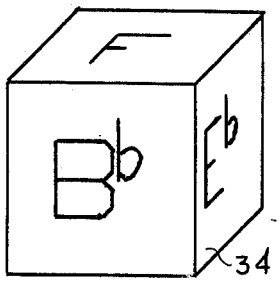
FIGS. 22 and 23 are perspective views of an alphabetic die employed in the advanced form of the game to determine a major key other than C, these views being taken from two different angles to show all sides of this alphabetic die.
Figure 23:
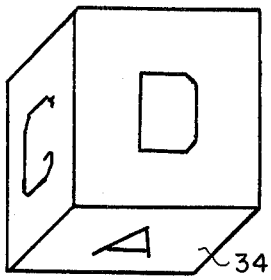

As shown in FIGS. 22 and 23, the alphabetic die 34 has six sides each bearing the designation of a different major key other than C. Although the major keys of A, B♭ (i.e., B flat), D, E♭ (i.e., E flat), F, and G have been employed, other major keys may also be employed. The alphabetic die 34 is hereinafter referred to as the major key die.

Figure 24:
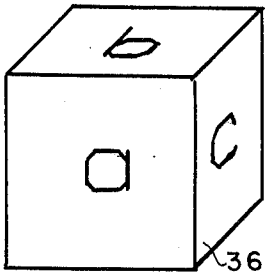
FIGS. 24 and 25 are perspective views of another alphabetic die employed in the advanced form of the game to determine a minor key, these views also being taken from two different angles to show all sides of this alphabetic die.
Figure 25:
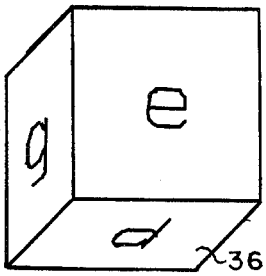
Figure 26:
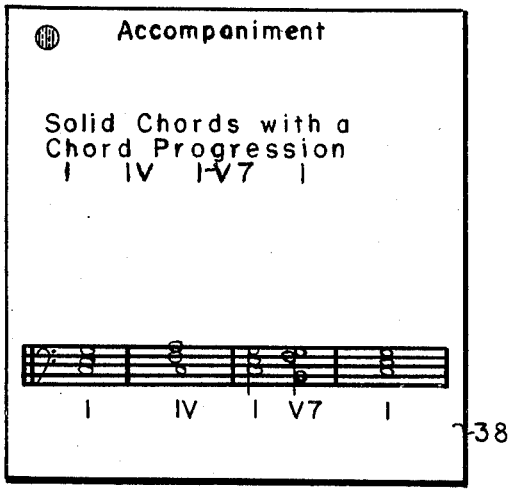
FIGS. 26–29 are plan views of four cards, each bearing a different musical accompaniment, that may be drawn in the advanced form of the game to determine an accompaniment for a musical composition.
Figure 27:
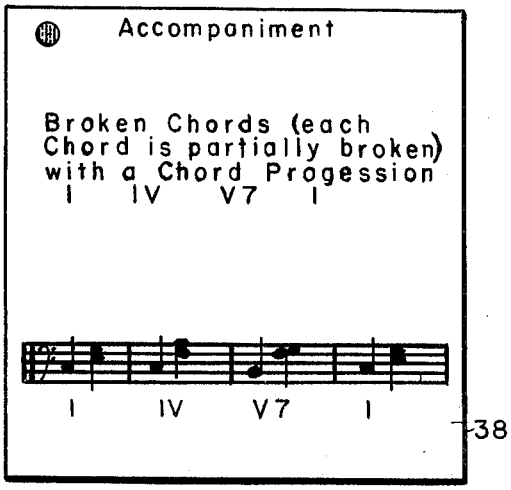
Figure 28:
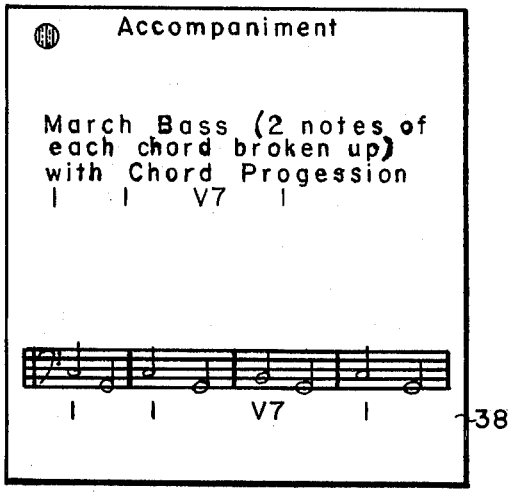
Figure 29:
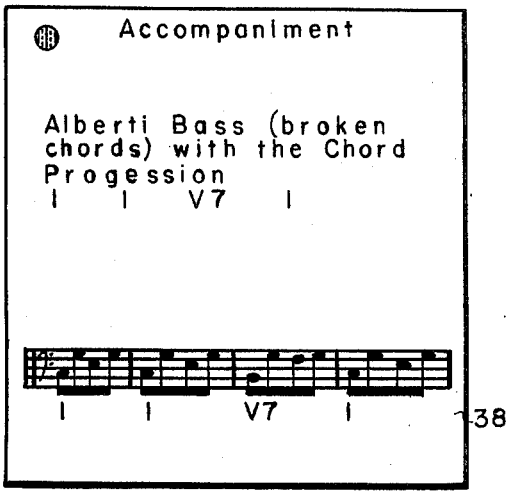

As shown in FIGS. 24 and 25, the alphabetic die 36 has six sides each bearing the designation of a different minor key. Although the minor keys of *a*, *b*, *c*, *d*, *e*, and *g* have been employed, other minor keys may also be employed. The alphabetic die 36 is hereinafter referred to as the minor key die.

As shown in FIGS. 26–29, there are four accompaniment cards 38 each bearing four measures of a different accompaniment and each colored pink as indicated by the circular color coding designation contained on each accompaniment card and the color coding key positioned above the playing board 10 in FIG. 1. Although solid chords, broken chords, march bass, and alberti bass accompaniments have been employed, other accompaniments may also be employed and the number of accompaniment cards increased if desired.

OBJECT

The object of the game is to compose four measures of music in ten or less turns and to earn as much play money as possible while doing so. In the advanced form of the game each player may elect to compose eight measures of music rather than four. The winner is the player who completes four or eight (if selected) measures of music and earns the most play money.

REGULAR GAME

To begin the game each of the players takes a seat around the playing board 10 and selects a different playing piece 14. One of the players is selected to distribute the play money 20 and the awards 24–32 to the players according to the rules set forth below. This player is given the title of Chairman of the Popularity Board and is hereinafter referred to by that title. All of the players then throw the popularity dice 16 to determine the order of play, the player obtaining the highest numerical total being first and being followed in turn by those players seated to his or her left around the playing board 10.

During each player's first turn in the determined order of play, he or she selects as a starting place on the playing board 10 whichever orange space 42 designates the time signature of his or her preference; places his or her playing piece 14 on the selected orange space; selects a piece of music paper 18 of the type he or she prefers; notates on the selected music paper the time signature designated in the selected orange space; and further notates in the major key of C either the measure of notes designated in the selected orange space or up to as many notes of his or her own selection as equal one measure of notes in the designated time signature (these notes may be arranged as a single measure or as parts of several different measures, but must include the beginning note of the first measure of his or her musical composition). The beginning note of the first measure of each player's musical composition may be notated at any one of the positions (i.e., may have any one of the pitches) indicated by the following:

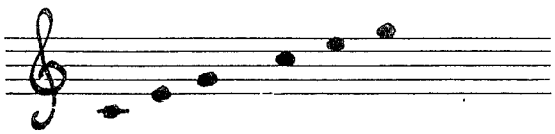

Each player must use the time signature designated in his or her selected orange space 42 and may only use those notes that can be properly used in the designated time signature according to the standard manuscript rules of musical composition, which should be followed, insofar as the players are familiar with them, in playing the game. Any player using either the $_8^5$ time signature or the $_8^6$ time signature is entitled to collect $75 in play money 20 from the Chairman of the Popularity Board since those time signatures are more difficult than the other time signatures included in the orange spaces 42 on the playing board 10. Each player who completes his or her first measure of music during his or her first turn (for example, by notating the measure of notes designated by his or her selected orange space 42) or during any of his or her subsequent turns is entitled to throw the popularity dice 16 during the turn in which he or she completes that measure of music. The numerical combination of the popularity dice 16 when thrown determines the popularity of his or her musical composition at that stage and entitles him or her to collect additional play money 20 from the Chairman of the Popularity Board as indicated by the following popularity table:

POPULARITY TABLE

| Combination of Popularity Dice | Money Earned |
|---|---|
| all 6's | $1,500 |
| all 5's | $1,250 |
| totals 15–17 | $1,000 |
| all 4's | $ 800 |
| totals 12–14 | $ 600 |
| all 3's | $ 450 |
| totals 9–11 | $ 300 |
| all 2's | $ 200 |
| totals 4–8 | $ 100 |
| all 1's | $ 75 |

During each of each player's remaining turns in the determined order of play until the game is completed, he or she spins the pointer 50 of the spin dial 22; moves his or her playing piece 14 either forward or backward from its current position on the peripheral portion 40 of the playing board 10 as many spaces 42 as are designated by the pointer of the spin dial once it comes to rest; and notates on his or her music paper 18 whichever musical term, symbol, or symbols are designated in the space to which his or her playing piece is moved as directed on the explanatory card 12 of the same color as that space. The designated musical term, symbol, or symbols may be notated anywhere in any one or more measures, but only as many musical symbols, such as notes or rests, may be notated as equal one measure in his or her time signature.

If a player's playing piece 14 lands on an orange space 42, he or she must notate the time signature designated in that orange space for at least one measure not already notated in his or her initial time signature and must notate either the measure of notes designated in that orange space or up to as many notes of his or her own selection as equal one measure of notes in the designated time signature just as explained above in connection with each player's first turn and as directed and illustrated on the orange explanation card 12 (FIG. 2). Every player is entitled to collect $75 from the Chairman of the Popularity Board for each additional time signature he or she uses in his or her musical composition.

If a player's playing piece 14 lands on a green space 42, he or she must notate a note or group of notes (not exceeding one measure of notes in his or her time signature) in accordance with the musical term designated in that green space as directed and illustrated on the green explanatory card 12 (FIG. 3). Each time a player's playing piece 14 lands on a green space 42 and he or she uses the musical term designated therein, he or she is entitled to collect $125 in play money 20 from the Chairman of the Popularity Board.

If a player's playing piece 14 lands on a blue space 42, such as accidentals, dotted rhythms, rests, <>, or ○, ♩, ♩, designating more than one musical symbol or including a musical term designating more than one musical symbol, he or she must notate one or more of the designated musical symbols as directed and illustrated on the blue explanatory card 12 (FIG. 4). Similarly, if a player's playing piece 14 lands on a blue space 42, such as ⌣, :||, or 8va, he or she must notate that musical symbol or one or more other musical symbols in any of several different ways as further directed and explained on the blue explanatory card 12. In any case, a player may only notate up to as many musical symbols as equal one measure of those musical symbols in his or her designated time signature.

If a player's playing piece 14 lands on a purple space 42, he or she must notate the musical symbol or term designated in that purple space as directed on the purple explanatory card 12 (FIG. 5). Althouth some of the musical symbols or terms designated in the purple spaces would normally be notated only once during a player's musical composition, others may be notated more than once if desired. Each time a player's playing piece 14 lands on a purple space 42 and he or she uses the musical term designated therein, he or she is entitled to collect $100 in play money 20 from the Chairman of the Popularity Board.

If a player's playing piece 14 lands on a white space 42, he or she must notate one or more musical symbols (not exceeding one measure of those musical symbols in his or her time signature) designated in that white space or by a musical term included therein as directed and illustrated on the white explanatory card 12 (FIG. 6). With specific regard to the white space 42 designating skip(s), a player may notate either the designated ascending skip and/or the designated descending skip or any other ascending skip or skips and/or descending skip or skips that can be properly notated in his or her time signature. Similarly, with specific regard to the white space 42 designating step(s), a player may notate either the designated ascending step and/or the designated descending step or any other ascending step or steps and/or descending step or steps that can be properly notated in his or her time signature.

As mentioned above, any player who completes his or her first measure of music during any of his or her turns is entitled during that turn to throw the popularity dice 16 to determine the popularity of his or her musical composition at that stage and to thereupon collect play money 20 from the Chairman of the Popularity Board based upon its determined popularity as indicated by the popularity table above. Moreover, any player who has completed his first measure of music is entitled at the end of each of his or her subsequent turns to throw the popularity dice 16 to determine the popularity of his or her musical composition at that stage amd to collect additional play money 20 from the Chairman of the Popularity Board based upon its determined popularity as indicated by the popularity table above, unless his or her playing piece 14 lands on a purple space 42. Although any player whose playing piece 14 lands on a purple space 42 during any of his or her turns is not entitled to throw the popularity dice 16 during that turn, as mentioned above, he or she is entitled to collect $100 in play money 20 from the Chairman of the Popularity Board if he or she uses the musical term designated in that purple space.

Permitting each player to move his or her playing piece 14 either forward or backward the number of spaces designated by the pointer 50 of the spin dial 22 during each of his or her turns enables him or her to choose from at least two different musical symbols or terms during each of his or her turns. For example, a player may choose to move his or her playing piece 14 backward the number of spaces designated by the pointer 50 of the spin dial 22 during any of his or her turns if by doing so his or her playing piece would land on a space 42 designating a musical symbol or term he or she would prefer to the musical symbol or term designated in the space on which his or her playing piece would land if moved forward the same number of spaces. Moreover, any player whose playing piece 14 would land on a space 42 designating a musical symbol or term he or she cannot or does not wish to use, whether moved forward or backward the number of spaces determined by spinning the spin dial 22 during any of his or her turns, may elect to respin the spin dial 22 and move his or her playing piece either forward or backward the number of spaces determined by respinning the spin dial. However, a player may only respin the spin dial 22 once during each of his or her turns and, if he or she elects to respin the spin dial, he or she is not entitled to throw the popularity dice 16 during that turn. In any case, once a player's turn is completed, he or she may not erase any portion of the music he or he has notated on his or her music paper 18.

Each time a player is able to circle the peripheral portion 40 of the playing board 10, he or she is entitled to collect $100 in play money 20 from the Chairman of the Popularity Board. A player may originate a title for his or her musical composition at any time during the game and is thereupon also entitled to collect $100 in play money 20 from the Chairman of the Popularity Board. In addition, each player who completes his or her musical composiion in ten or fewer turns is entitled to collect a bonus of $300 in play money 20 from the Chairman of the Popularity Board. Each player should therefore carefully tally the number of turns he or she has used by, for example, marking them in the turn tally area at the bottom of his or her music paper 18 (FIGS. 10 and 11). In any case, the ending note of the last measure of each player's musical composition must be a keynote notated at either of the positions (i.e., must have either of the pitches) indicated by the following:

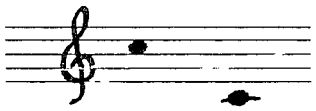

Each player who has not completed his or her musical composition after completion of his or her first ten turns takes enough additional turns in the determined order of play to finish his or her musical composition, but is not entitled to throw the popularity dice 16 during those additional turns. However, each such player is still entitled to collect from the Chairman of the Popularity Board $75 in play money 20 during each of those additional turns in which he or she lands on an orange space 42 and uses an additiional time signature designated therein, $125 in play money 20 during each of those additional turns in which he or she lands on a green space 42 and uses the musical term designated therein, and $100 in play money 20 during each of those additional turns in which he or she lands on a purple space 42 and uses the musical term designated therein.

Each player who has completed his or her musical composition may also take additional turns in the determined order of play until the last player has finished his or her musical composition, but is not entitled to throw the popularity dice 16 during those additional turns. However, each such player is also still entitled to collect from the Chairman of the Popularity Board $125 in play money 20 during each of those additional turns in which he or she lands on a green space 42 and uses the musical term designated therein and $100 in play money 20 during each of those additional turns in which he or she lands on a purple space 42 and uses the musical term designated therein. In addition, each such player is entitled to collect $75 in play money 20 from the Chairman of the Popularity Board during each of those additional turns in which he or she lands on any other space 42 and uses the musical symbol or term designated therein. Since a player who has completed his or her musical composition can no longer use rhythmic symbols, the number of spaces 42 designating musical symbols or terms he or she can use is limited to the green space designating anacrusis, some of the blue spaces (for example, those designating ◡ and 8va), all of the purple spaces, and some of the white spaces (for example, those designating > or ⌒).

A money distribution table summarizing all of the ways in which the players may earn play money 20 is included in the glossary below to aid the Chairman of the Popularity Board in distributing, and the players in claiming, the play money 20 earned by the players. This money distribution table may also be provided on a separate card, like the explanatory cards 12 (FIGS. 2–6), for the use of the Chairman of the Popularity Board. A supply of such cards may additionally be provided for the use of each player if desired.

Once every player has completed his or her musical composition, or sooner if agreed upon by the players, the winner is determined and the awards 24–32 (FIGS. 17–21) distributed by the Chairman of the Popularity Board. The winner is the player who has completed a musical composition of four measures and who has earned the most play money 20 while doing so. In recognition of this accomplishment, the winner is awarded the highest award for which he or she is qualified based upon the following award table:

AWARD TABLE

| Awards | Money Earned |
|---|---|
| Broadway Hit Parade Award | $5,000 and over |
| Silver Screen Award | $4,500 – $4,999 |
| Disk Award | $3,500 – $4,499 |
| Telly Award | $2,500 – $3,499 |
| Rejection Slip Award | $2,499 and under |

Figure 21:
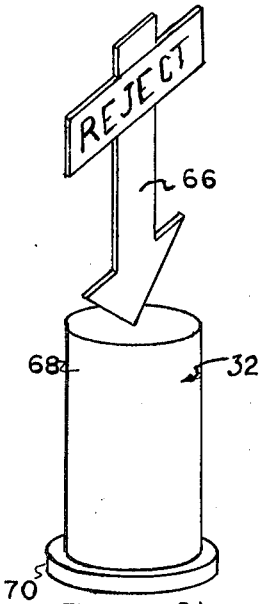

Thus, for example, the winner is awarded the Broadway Hit Parade Award 24 (FIG. 17) if he or she has earned $5,000 or more in play money 20, or is awarded the Silver Screen Award 26 (FIG. 18) if he or she has earned $4,700 in play money. The remaining awards of lesser importance are distributed to the other players on the same basis (i.e., the player who has completed a musical composition of four measures and who has earned the next most play money 20 is entitled to the next highest award for which he or she is qualified based upon the above award table). Thus, for example, the runner-up is awarded the Silver Screen Award 26 (FIG. 18) if he or she has also earned $5,000 or more in play money 20, is awarded the Disk Award 28 (FIG. 19) if he or she has earned $4,000 in play money 20, or is awarded the Telly Award 30 (FIG. 20) if he or she has earned $2,650 in play money 20. Every player who completes a musical composition of four measures and earns $2,499 or less in play money 20, or who fails to complete a musical composition of four measures, is awarded a Rejection Slip Award 32 (FIG. 21).

An example of how a player composes four measures of music and earns play money, as well as an award, in playing the game is given in the composition table below. In this composition table the first column represents the player's different turns in the determined order of play; the second column represents the spaces on which the player's playing piece is placed during his or her first turn and on which the player's playing piece lands, as determined by spinning the spin dial, during his or her subsequent turns; the third column represents the musical term, symbol, or symbols notated by the player on his or her music paper during each of his or her turns; and the fourth column represents the play money or award earned by the player, as determined by throwing the popularity dice, the color of the space on which he or she lands, the music he or she notates, etc., during each of his or her turns.

COMPOSITION TABLE

| Turn | Space | Notation | Money/Award Earned |
|---|---|---|---|
| 1 | 4<br>4<br><br>(orange) | 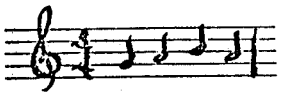 | popularity dice:<br>$600 |

COMPOSITION TABLE -continued

| Turn | Space | Notation | Money/Award Earned |
|---|---|---|---|
| 2 | NEIGHBORING TONE<br>(green) | | popularity dice: $100<br>green space: $125 |
| 3 | :\|\|<br>(blue) | | popularity dice: $1,000 |
| 4 | rit.<br>(purple) | Snoopy at the Piano<br>rit. | title: $100<br>purple space: $100 |
| 5 | d.d.o.<br>(blue) | rit. | popularity dice: $300 |
| 6 | SYNCOPATION<br>(green) | rit. | popularity dice: $300<br>green space: $125 |
| 7 | STEP(S)<br>(white) | rit. | popularity dice: $300 |
| 8 | <br>(white) | rit | popularity dice: $600<br>bonus: $300 |
| 9 | ><br>(white) | rit. | non-rhythmic notation: $ 75 |

-continued

| | | |
|---|---|---|
| 10 | (blue) | non-rhythmic notation: $ 75<br>TOTAL: $4,100<br>AWARD: DISK AWARD |

ADVANCED GAME

All of the rules set forth above in the description of the regular form of the game also apply to the advanced form of the game. The additional rules and variations set forth below in the description of the advanced form of the game may be followed either in whole or in part depending on the skill of the players. Moreover, additional rules and variations may be formulated by the players themselves to better adapt the game to their level of skill.

Each player may elect to lengthen his or her musical composition to eight measures and, if he or she elects to lengthen his or her musical composition, is entitled to collect $100 in play money 20 from the Chairman of the Popularity Board. In addition, each player may elect to throw either the major key die 34 (FIGS. 22 and 23) or the minor key die 36 (FIGS. 24 and 25) to determine a major or minor key other than the major key of C in which to notate his or her musical composition. Each player using a major key, such as A, B♭, D, E♭, F, or G, determined by throwing the major key die 34 is entitled to collect $100 in play money 20 from the Chairman of the Popularity Board since the major keys designated on the major key die 34 require more knowledge than the major key of C. Similarly, each player using a minor key, such as *a*, *b*, *c*, *d*, *e*, and *g*, determined by throwing the minor key die 36 is entitled to collect $200 in play money 20 from the Chairman of the Popularity Board since the minor keys designated on the minor key die 36 are even more difficult than the major keys designated on the major key die 34. The key signatures for the major and minor keys designated on the major and minor key dice 34 and 36 are indicated by the following (the key signature for the minor key of a being a blank as in the case of the major key of C):

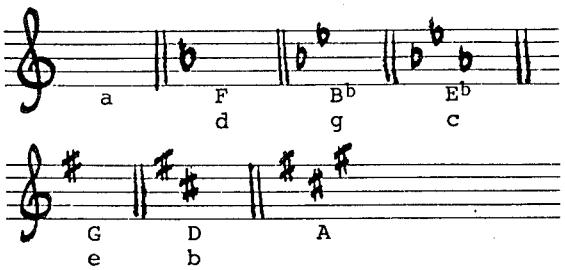

In the same manner as explained above in the description of the regular form of the game, during his or her first turn each player places his or her playing piece 14 on the orange space 42 designating the time signature he or she prefers; notates the designated time signature; notates the key signature of the determined key (unless he or she has elected not to throw either of the major and minor key dice 34 and 36 or has thrown the minor key die 36 and obtained the minor key of (a); and notates in the determined major or minor key either the measure of notes designated in the selected orange space or up to as many notes of his or her own selection as equal one measure of notes in the designated time signature (these notes must include the beginning note of the first measure of his or her musical composition). However, if a player prefers, he or she may simply notate the designated time signature, the key signature of the determined key, and the beginning note of his or her musical composition; may then spin the pointer 50 of the spin dial 22 and move his or her playing piece 14 either forward or backward the number of spaces 42 designated by the pointer 50 once it comes to rest; and may thereupon notate the musical term, symbol, or symbols designated in the space on which his or her playing piece lands.

Any player whose playing piece 14 lands on a green, blue, or white space 42 containing a red star 44 may employ a variation requiring greater skill and entitling him or her to collect additional play money 20 from the Chairman of the Popularity Board. For example, any player landing on the white space 42 designating skip(s) and containing a red star 44 may divide the melody by adding any interval above or below the melody, such as 2nds (causing dissonance) or 3rds or 6ths (both causing consonance) as indicated by the following:

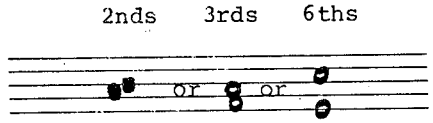

Any player doing this is entitled to collect $100 in play money from the Chairman of the Popularity Board. The other variations are explained below in connection with accompaniments.

Each player may at any time elect to notate an accompaniment for the melody of his or her musical composition, in which case he or she uses the music paper 18 (FIG. 11) of the type notated for both treble and base clefs. Any accompaniment of a player's own choice may be notated. Alternatively, a player may draw one of the four pink accompaniment cards 38 (FIGS. 26–29), which should be shuffled and placed face down on the playing board 10, and notate the accompaniment designated on the drawn accompaniment card. Although a player must use the style of the accompaniment (i.e., solid chords, broken chords, march bass, or alberti bass) designated on the drawn accompaniment card 38, he or she may notate either the chord progression designated on the drawn accompaniment card or any other chord progression in the designated style of accompaniment as he or she chooses. In any case, during each of his or her turns a player may only notate up to as many notes in each of the treble and base clefs as equal one measure of melody and one measure of accompaniment. Each player notating an accompaniment for the melody of his or her musical composition is entitled to collect $100 in play money 20 from the Chairman of the Popularity Board.

In notating an accompaniment a player may use any triad and may also use the V7 chord (although use of a triad requires two skips and use of the V7 chord in a major key requires an additional skip and in a minor key requires an accidental and an additional skip, a player's playing piece 14 need not land on the white space 42 designating skip(s) or the blue space 42 designating accidentals in order to use a triad or the V7 chord in a major or minor key in his or her accompaniment). Each player who notates one or more secondary triads in his or her accompaniment is entitled to collect $100 more in play money 20 from the Chairman of the Popularity Board. In addition, each player who notates the musical term, symbol, or symbols designated in the space 42 upon which his or her playing piece 14 lands, if applicable, in his or her accompaniment is also entitled to collect $100 more in play money from the Chairman of the Popularity Board. Moreover, each player whose playing piece 14 lands on a green, blue, or white space 42 containing a red star 44 and who notates musical symbols designated by the musical terms

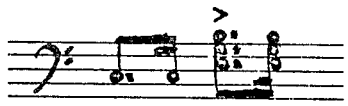

Each player notaing this variation in his or her accompaniment is also entitled to collect $125 in play money 20 from the Chairman of the Popularity Board.

A player whose playing piece 14 lands on the white space 42 containing a red star 44 and designating skip(s) may add to any existing chord in his or her accompaniment another one or two thirds making a 7th or 9th chord as, for example, is indicated by the following:

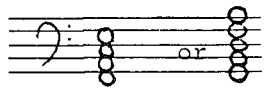

IV7 V9

Some of the middle notes may be omitted from the 7th or 9th chord as, for example, is further indicated by the following:

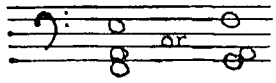

IV7 V9

Each player notating this variation in his or her accompaniment is entitled to collect $150 in play money 20 from the Chairman of the Popularity Board.

A player whose playing piece 14 lands on the blue space 42 containing a red star 44 and designating accidentals may use dissonance in his or her accompaniment as, for example, is indicated by the following:

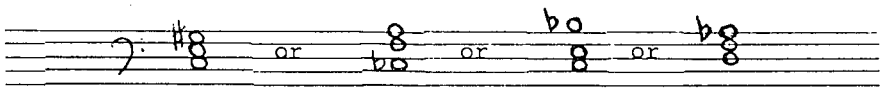

I+ IV(b5) I7(b7) ii included in those spaces in his or her accompaniment in the manner indicated by one of the variations below is entitled to collect from $125 to $200 more (rather than $100 more) in play money 20 from the Chairman of the Popularity Board as further indicated in connection with the variations below.

A player whose playing piece 14 lands on the green space 42 containing a red star 44 and designating syncopation may notate a swing bass in his or her accompaniment as, for example, is indicated by the following (one or more staccato and/or accent symbols may be used in the swing bass without landing on the white spaces 42 designating those symbols):

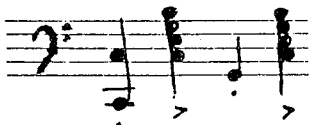

Each player notating this variation in his or her accompaniment is entitled to collect $125 in play money 20 from the Chairman of the Popularity Board.

A player whose playing piece 14 lands on the blue space 42 containing a red star 44 and designating dotted rhythms may notate a boogie bass in his or her accompaniment as, for example, is indicated by the following:

Each player notating this variation in his or her accompaniment is also entitled to collect $150 in play money 20 from the Chairman of the Popularity Board.

A player whose playing piece 14 lands on the blue space 42 containing a red star 44 and designating accidentals may also change keys either temporarily or permanently in his or her accompaniment. This is called modulation and may be accomplished by employing a chord common to both the previous key and to the new key (for example, the chord C E G is the I chord in the key of C and the IV chord in the key of G) or by notating the V7 chord of the new key as indicated, for example, by the following:

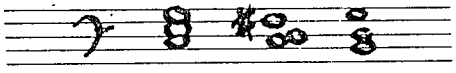

CI GV7 GI

The modulation may also be accomplished by notating two chords in succession having a chromatic progression (for example, the chromatic progression from a I (C E G) chord in the key of C to a V7 (A C♯E) chord in the key of D) as, for example, is indicated by the following:

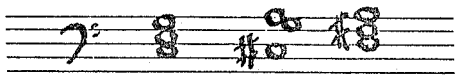

CI DV7 DI

The last-mentioned type of modulation is normally referred to as chromatic modulation. Each player notating any form of this variation in his or her accompaniment is entitled to collect $200 in play money 20 from the Chairman of the Popularity Board.

As explained above a player may use an accidental and/or one or more skips when notating a triad or a V7 chord in a minor or major key in his or her accompaniment without the necessity of landing on the blue space 42 designating accidentals or the white space 42 designating skip(s). However, in this case he or she is not entitled to collect play money 20 from the Chairman of the Popularity Board as in the above-described cases where he or she lands on those spaces and notates musical symbols in his or her accompaniment as designated by those terms or as explained in the corresponding variations.

An example of how a player composes eight measures of music and earns play money, as well as an award, in playing the advanced form of the game is given in the composition table below. This composition table is arranged in the same manner as the composition table included in the above description of the regular form of the game. When taken together, these two composition tables provide an example of how a beginning player and an advanced player may play the regular and advanced forms of the game at the same time.

COMPOSITION TABLE

| Turn | Space | Notation | Money/Award Earned |
|---|---|---|---|
| 1 | 6/8 (orange) | 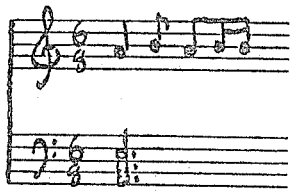 | 6/8 time sig.: $ 75 |
| | spins the spin dial | | 8 measures: $100 |
| | DIMINUTION (green) | | accompaniment: $100 |
| | | | green space: $125 |
| | 6/8 (orange) | 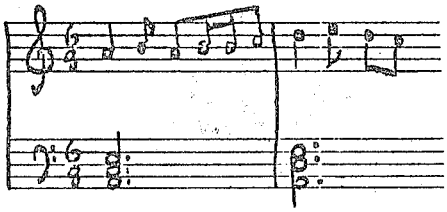 | popularity dice: $1,000 |
| 3 | SEQUENCE (green) | 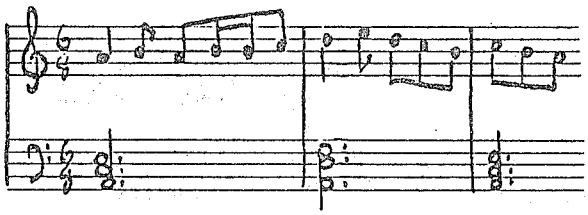 | popularity dice: $600 |
| | | | green space: $125 |
| 4 | 2/4 (orange) | 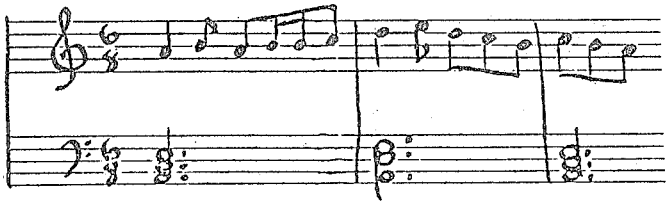 | 2nd time sig.: $ 75 |
| | | | popularity dice: |

COMPOSITION TABLE
| Turn | Space | Notation | Money/Award Earned |
|---|---|---|---|
| | | 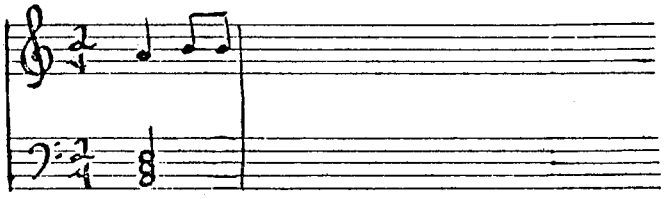 | $100 |
| 5 | (white) | 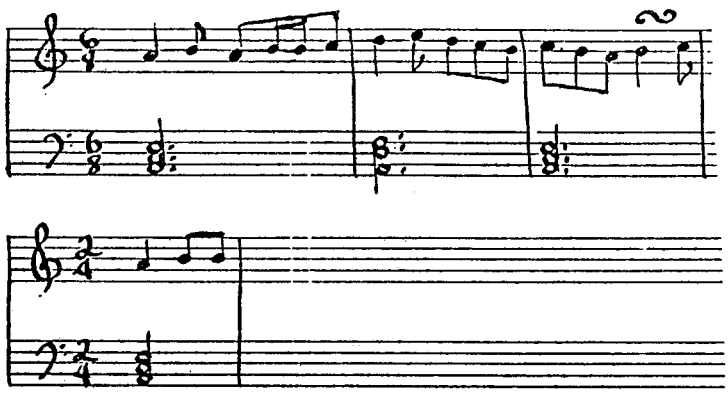 | popularity dice: $600 |
| 6 | (white) | 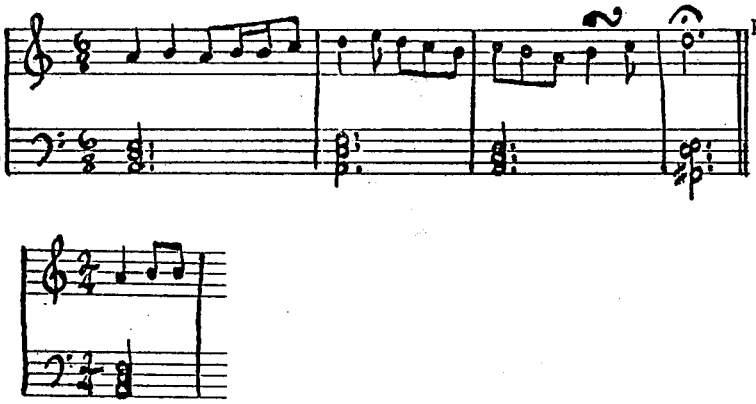 | popularity dice: $450 |
| 7 | DOTTED RHYTHMS (blue) | 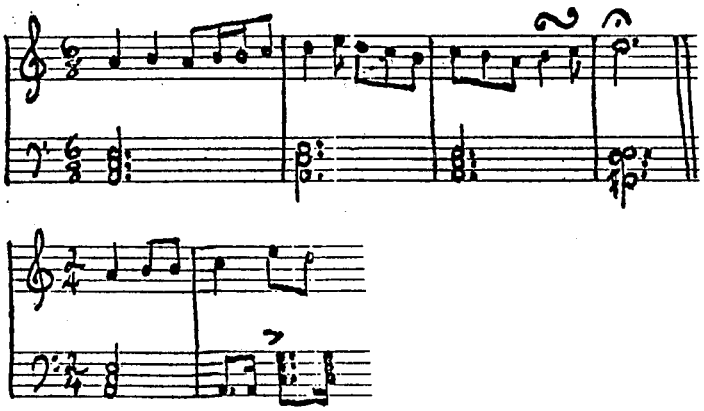 | popularity dice: $100 variation (★): $125 |

COMPOSITION TABLE

| Turn | Space | Notation | Money/Award Earned |
|---|---|---|---|
| 8 | (white) | | popularity dice: $600 |
| 9 | SKIP(S) (white) | | popularity dice: $300 bonus: $300 |
| 10 | ALLEGRO (purple) | Allegro | purple space: $100 TOTAL: $5,075 AWARD: BROADWAY HIT PARADE AWARD |

GLOSSARY

REGULAR GAME

BAR: Vertical line dividing the staff into measures.

BEAT: Pulse by which the rhythm of a composition is established.

CLEF: Symbol notated at the beginning of a staff that establishes the pitch of all the lines and spaces of the staff. The treble clef 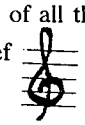 and the bass clef 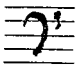 are the most commonly used clefs.

DOT: If notated alongside a note (for example, ♩. ) it means half the value of the notated note plus the value of the notated note (thus, ♩. would receive 1½ beats). If notated above or below a note (for example, ♩ ) it means staccato (i.e., short).

DOUBLE BAR: Two vertical lines placed close together indicating the end of a composition and/or change of time signature.

KEY: The tonality center of a composition. The simplest key is the key of C (indicated by not notating anything in the key signature).

KEYNOTE: The first note of a scale.

KEY SIGNATURE: The sharps ( # ) or flats ( ♭ ) indicating the key in which the composition is written as illustrated by the following example for the key of F

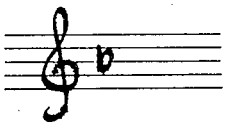

MEASURE: The notes or rests included between two bars sub-dividing a composition into equal groups of beats as illustrated by the following example

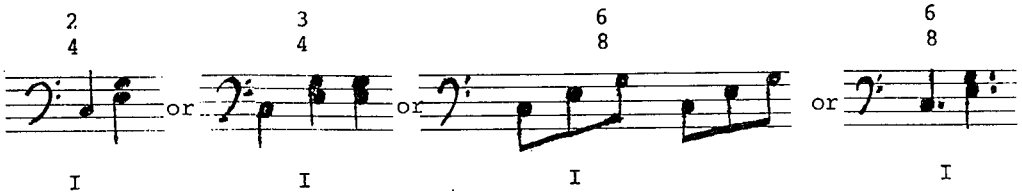

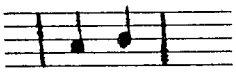

MELODY: A tune or song that is easily remembered. It consists of ascending and/or descending skips and/or steps (see the white explanatory card).

OCTAVE: Eight notes higher or lower.

PITCH: Quality of a sound determined by the number of vibrations per second. The pitches for both the treble and bass clefs are indicated below

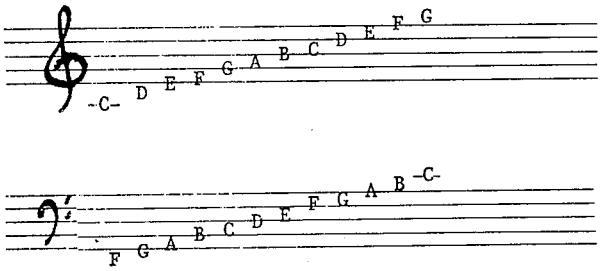

RHYTHM: Arrangement of notes within a measure.

SHARP: See ACCIDENTALS on the blue explanatory card.

STAFF: The five horizontal lines and four spaces upon which music is notated.

TIME SIGNATURE: A sign, such as $_4^2$, $_8^5$, $_8^6$, $_4^3$, or $_4^4$, indicating the number of beats per measure (top number) and the kind of note receiving one beat (bottom number). Thus, in the $_4^2$ time signature there are two beats per measure and the quarter note (♩) equals one beat. Similarly, in the $_8^5$ and $_8^6$ time signatures there are five and six beats per measure, respectively, and the eighth note (♪) equals one beat so all notes have a double value.

TONE: Sound having a definite pitch as indicated by the various notes.

ADVANCED GAME

ACCOMPANIMENT: The supporting background of a melody.

ALBERTI BASS: An accompaniment in which each chord is broken up as single notes (usually twice as fast as the melody) as illustrated by the following example

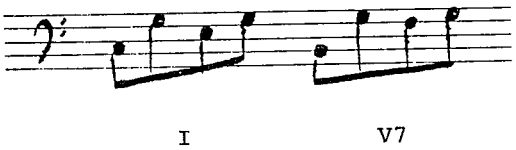

BROKEN CHORDS: An accompaniment notated as illustrated by the following examples in different time signatures CHORDS: Three or more tones sounded simultaneously (usually arranged in intervals of thirds) as indicated by the following examples

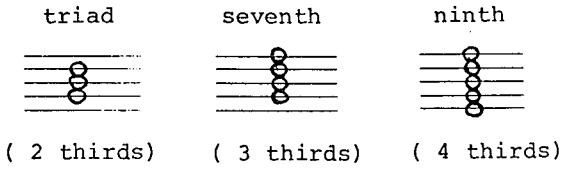

The principal chords are I, IV, and V7. They are illustrated below

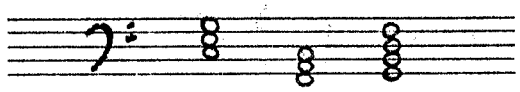

I IV V7

The I and IV chords are triads built on the keynote and 4th tone of the major and minor scales. The V7 (Dominant Seventh) chord is built on the 5th tone of the major and minor scales. The secondary chords in the major and minor keys are II, III, and VI. See TRIADS and SEVENTHS.

CONSONANCE: Combination of two or more tones which produce a pleasing sound to the ear.

DISSONANCE: Intervals, chords, or triads causing harmonic tension. Dissonant intervals include, for example, the major second (M2), minor second (*m*2), major seventh (M7), minor seventh (m7), and all augmented (+) and diminished (*o*) intervals, as illustrated below

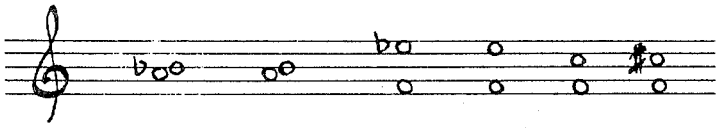

m2 M2 m7 M7 5o 5+

Dissonant chords are illustrated below --

Major triads-may be augmented

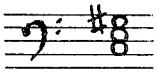

I+ or 5th flatted

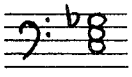

I b5 or a 3rd may be added (making them into a 7th)

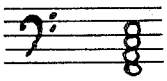

IV7

Minor triads-may be diminished

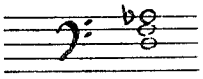

ii or a 3rd may be added (making them into a minor 7th)

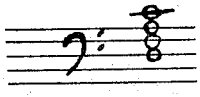

ii7

Major sevenths-with 7th lowered

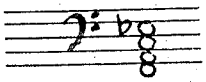

IV7 (b7)

or with 7th lowered and 5th raised

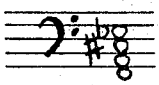

IV7 (b7,#5)

or with 7th and 5th both lowered

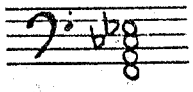

IV7 (b7,b5)

or a 3rd may be added (making them into a 9th with b7)

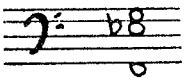

IV9

Minor sevenths-with 5th lowered

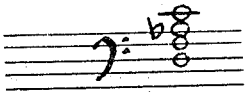

ii7 or with 7th raised

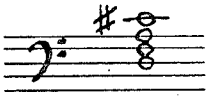

ii7 (#7)

See INTERVALS and SEVENTHS.

DOMINANT SEVENTH: See CHORDS.

FIFTH: See INTERVALS.

INTERVALS: The distance between two tones either simultaneously or side by side. Intervals are named according to the number of staff lines and spaces between and including the lower note and the higher note as illustrated below

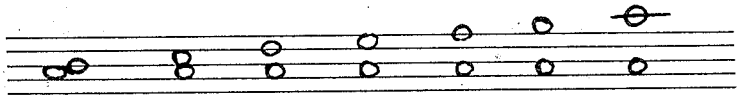

2nd 3rd 4th 5th 6th 7th octave

Major intervals are designated by M; minor intervals by *m;* diminished intervals, chords, or triads by o; augmented intervals, chords, or triads by +; and perfect intervals by P.

m2-interval of a half step

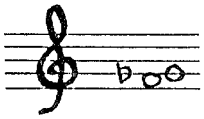

M2-interval of a whole step

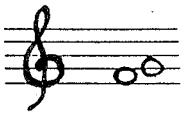

-continued m3-interval of 1½ steps

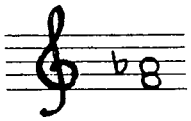

M3-interval of 2 whole steps

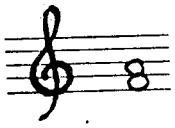

P5-interval of M3 + m3 (3½ steps)

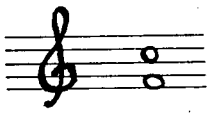

m7-interval of P5 + m3 (5 steps)

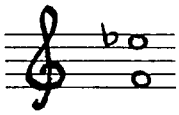

M7-interval of P5 + M3 (5½ steps)

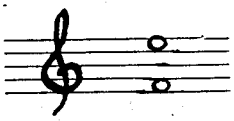

To make any M into a m interval, notate the M interval ½ step smaller

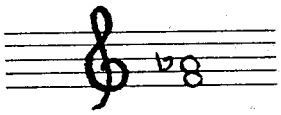

To diminish any m or P interval, notate the m or P interval ½ step smaller

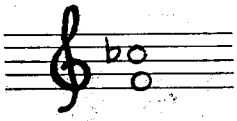

To augment any M or P interval, notate the M or P interval ½ step larger

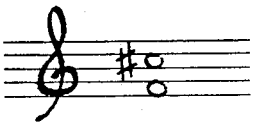

MARCH BASS: An accompaniment in which only two notes of each chord are used and notated broken up (the I moves either up or down from the root to the 5th and the V7 moves either up or down from the 7th, 2nd, or 4th to the 5th) as illustrated by the following example

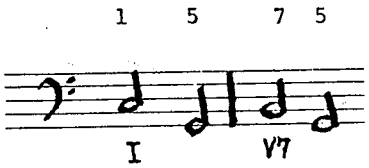

MODES: A stepwise arrangement of ascending or descending tones, each having a pattern of whole and one-half steps (the latter being designated by ∨), as illustrated below.

1. Major scale

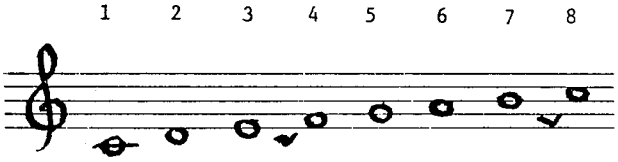

2. Natural minor scale (begins on the sixth tone of its relative major scale)

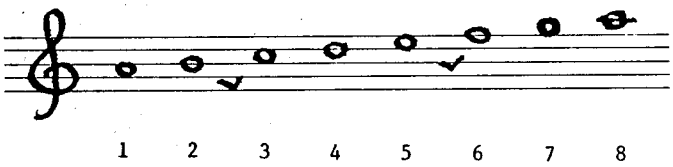

See RELATIVE KEYS and DOMINANT SEVENTH in minor.

RELATIVE KEYS: Major and minor keys having the same key signatures but different letter names as illustrated by the following example

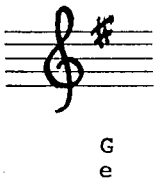

ROOT: Lowest note of a chord according to the musical alphabet. See CLEF. For instance, in the following example, the root is D, not A

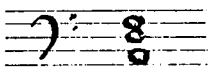

SCALE: See MODES.

SEVENTH: A triad with another 3rd added. The most common triad used is the Dominant Seventh. See CHORDS.

THIRD: See INTERVALS.

TRIAD: A chord having three tones arranged in intervals of 3rds (i.e., on three successive lines or on three successive spaces of a staff). Triads can be built on any note of the scale and are indicated by Roman numerals standing for the scale degree upon which they are built as illustrated below

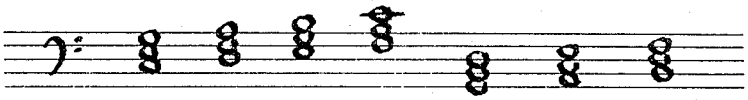

I ii iii IV V vi vii

The major triads are I, IV, and V in all major keys, and the minor triads are II, III, and VI in all major keys. Augmented traids have M3 and augmented 5th as illustrated below

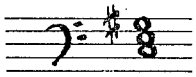

I+

Diminished triads have m3 and diminished 5th. The VII in a major key is always a diminished triad. See CHORDS, INTERVALS, and DISSONANCE.

stages, and a supply of staff-lined music paper for use in notating musical compositions as determined by movement of the playing pieces along said portion of the playing board.

2. A musical composition game as in claim 1 wherein said portion of the playing board comprises a continuous peripheral portion of the playing board, and each space of the continuous peripheral portion of the playing board is colored one of several different colors.

3. A musical composition game as in claim 2 wherein a plurality of spaces of one of said colors serve as starting spaces from which the playing pieces may be moved either forward or backward along the continuous peripheral portion of the playing board a number of

MONEY DISTRIBUTION TABLE

A or $_8^6$ TIME SIGNATURE: $75
EACH ADDITIONAL TIME SIGNATURE: $75
GREEN SPACE: $125
PURPLE SPACE: $100 (Don't throw popularity dice)
POPULARITY DICE (combination of three dice):

| | | | |
|---|---|---|---|
| All 6's | $1,500 | All 3's | $450 |
| All 5's | $1,250 | Totals 9–11: | $350 |
| Totals 15–17: | $1,000 | All 2's | $200 |
| All 4's | $ 800 | Totals 4–8: | $100 |
| Totals 12–14 | $ 600 | All 1's: | $ 75 |

ORIGINAL TITLE: $100
EACH CIRCLING OF BOARD (before end of game): $100
COMPLETING MUSICAL COMPOSITION WITHIN TEN ATTEMPTS; $300
NONRHYTHMIC NOTATIONS AFTER COMPLETION OF MUSICAL COMPOSITION: $75
EIGHT MEASURES (ADVANCED GAME): $100
MAJOR KEY DIE (ADVANCED GAME): $100
MINOR KEY DIE (ADVANCED GAME): $200
NOTATION OF AN ACCOMPANIMENT (ADVANCED GAME): $100
NOTATION OF SECONDARY TRIADS IN ACCOMPANIMENT: $100
NOTATION DESIGNATED BY GREEN, BLUE, PURPLE, OR WHITE SPACES IN ACCOMPANIMENT (ADVANCED GAME): $100
NOTATION OF SWING BASS IN ACCOMPANIMENT (ADVANCED GAME VARIATION): $125
NOTATION OF BOOGIE BASS IN ACCOMPANIMENT (ADVANCED GAME VARIATION): $125
ADDITION OF ANOTHER ONE OR TWO THIRDS TO AN EXISTING CHORD IN ACCOMPANIMENT TO MAKE A 7th OR 9th CHORD (ADVANCED GAME VARIATION): $150
USE OF DISSONANCE IN ACCOMPANIMENT (ADVANCED GAME VARIATION): $150
USE OF MODULATION IN ACCOMPANIMENT (ADVANCED GAME VARIATION): $200

AWARD DISTRIBUTION TABLE

| | |
|---|---|
| Broadway Hit Parade Award | $5,000 and over |
| Silver Screen Award | $4,500 – $4,999 |
| Disk Award | $3,500 – $4,499 |
| Telly Award | $2,500 – $3,499 |
| Rejection Slip Award | $2,499 and under |

I claim:

1. A musical composition game comprising a playing board having a portion divided into a plurality of spaces including different musical symbols or terms used in musical composition and relating at least to melody and rhythm, a plurality of playing pieces for movement along said portion of the playing board to determine the musical symbols or terms to be notated in composing musical compositions, means of chance for regulating movement of the playing pieces along said portion of the playing board, means of chance for determining the popularity of a musical composition at different spaces determined by the means of chance for regulating movement of the playing pieces.

4. A musical composition game as in claim 3 including a supply of play money awarded according to both chance and skill.

5. A musical composition game as in claim 3 wherein some of the spaces of the continuous peripheral portion of the playing board includes musical symbols or terms relating to dynamics and tempo, and each of said plurality of spaces of said one of said colors designates a different time signature to be used in composing a musical composition.

6. A musical composition game as in claim 5 wherein some of the spaces of the continuous peripheral portion of the playing board include an indication of an alternate, moreadvanced musical composition technique that may be used in a musical composition.

7. A musical composition game as in claim 4 wherein some of the spaces of the continuous peripheral portion of the playing board include musical symbols or terms of greater difficulty to incorporate in a musical composition than the musical symbols or terms of other spaces.

8. A musical composition game as in claim 6 wherein the means of chance for regulating movement of the playing pieces comprises a spin dial, the means of chance for determining the popularity of a musical composition comprises a plurality of numeric dice, and the musical composition game further includes a plurality of alphabetic dice that may be used for determining a minor key or a major key other than C, and a plurality of cards bearing different accompaniments that may be selected by chance for use in a musical composition.

9. A musical composition game as in claim 8 including a plurality of awards.

10. A musical composition game as in claim 1 wherein the spaces of said portion of the playing board include different musical symbols or terms used in musical composition and relating to dynamics, melody, rhythm, and tempo.

11. A musical composition game as in claim 10, wherein some of the spaces of said portion of the playing board include a choice of musical symbols or terms to be notated.

12. A musical composition game as in claim 10 wherein each of the spaces of said portion of the playing board includes a different musical symbol or term used in musical composition.

13. A musical composition game as in claim 1 wherein said portion of the playing board comprises a continuous peripheral portion of the playing board divided into a plurality of contiguous spaces each including a musical symbol or term used in musical composition.

14. A musical composition game as in claim 13 wherein the playing board is rectangular in shape, and the spaces of the continuous peripheral portion of the playing board include different musical symbols or terms on each side of the playing board.

15. A musical composition game as in claim 13 wherein each of the spaces of the continuous peripheral portion of the playing board is colored one of several different colors, a plurality of spaces of at least one of said colors being associated with a reward or a penalty.

16. A musical composition game as in claim 13 wherein selected ones of the spaces of the continuous peripheral portion of the playing board include different time signatures to be notated, and selected ones of those time signatures are of greater difficulty than others and are therefore associated with a reward.

17. A musical composition game as in claim 13 wherein some of said spaces of the continuous peripheral portion of the playing board include musical symbols or terms of greater difficulty than those included in other spaces of the continuous peripheral portion of the playing board, notation of selected ones of said musical symbols or terms of greater difficulty being associated with a reward.

18. A musical composition game as in claim 13 wherein some of said spaces include an indication of an alternate, moreadvanced musical composition technique that may be used in a musical composition, each of said alternate, more-advanced musical composition techniques being associated with a reward.

19. A musical composition game as in claim 1 including means of chance for determining a major or a minor key in which a musical composition is to be composed.

20. A musical composition game as in claim 19 wherein the means of chance for determining a major or a minor key includes a first alphabetic die for determining a major key and a second alphabetic die for determining a minor key.

21. A musical composition game as in claim 1 including a plurality of accompaniment cards bearing different accompaniments that may be selected by chance for use in a musical composition.

22. A musical composition game as in claim 1 including means for designating more-advanced musical composition techniques of an advanced form of the musical composition game that may be played on the playing board at the same time as a regular form of the musical composition game.

23. A musical composition game as in claim 1 wherein different groups of spaces of said portion of the playing board are colored different colors, and the musical composition game includes a plurality of explanatory cards each colored the same color as a corresponding one of said groups of spaces and including explanations and directions related to those spaces and the musical symbols or terms included therein.

24. A musical composition game as in claim 1 including a supply of play money awarded according to both chance and skill as a musical composition is composed, the supply of play money including different denominations each bearing the name and likeness of a different musical composer.

25. A musical composition game as in claim 24 including a plurality of different awards.

26. A musical composition game as in claim 25 wherein the awards comprise figures related to the field of entertainment.

27. A musical composition game as in claim 1 wherein each of the playing pieces comprises a statuette of a different musical composer.

28. A musical composition game as in claim 1 wherein the means of chance for regulating movement of the playing pieces comprises a spin dial, and the means of chance for determining the popularity of a musical composition comprises a plurality of numeric dice.

29. A musical composition game comprising a playing board having a portion divided into a plurality of spaces including different musical symbols or terms used in musical composition and relating at least to melody and rhythm, a plurality of playing pieces for movement along said portion of the playing board to determine the musical symbols or terms to be notated in composing musical compositions, means of chance for regulating movement of the playing pieces along said portion of the playing board, and means of chance for determining a major or a minor key in which a musical composition is to be composed.

30. A musical composition game as in claim 29 wherein the means of chance for determining a major or a minor key includes a first alphabetic die for determining a major key and a second alphabetic die for determining a minor key.

* * * * *